US006549104B1

(12) United States Patent
Ghosh et al.

(10) Patent No.: US 6,549,104 B1
(45) Date of Patent: Apr. 15, 2003

(54) TUNEABLE CAVITY RESONATOR

(75) Inventors: Indra Ghosh, Cologne (DE); Ulrich Poppe, Duren (DE); Norbert Klein, Monchengladbach (DE); Klaus Schieber, Backnang (DE)

(73) Assignees: Forschungszentrum Julich GmbH (DE); Robert Bosch GmbH (DE)

( * ) Notice: Subject to any disclaimer, the term of this patent is extended or adjusted under 35 U.S.C. 154(b) by 0 days.

(21) Appl. No.: 09/786,760

(22) PCT Filed: Aug. 13, 1999

(86) PCT No.: PCT/EP99/05959

§ 371 (c)(1),
(2), (4) Date: Jun. 8, 2001

(87) PCT Pub. No.: WO00/14823

PCT Pub. Date: Mar. 16, 2000

(30) Foreign Application Priority Data

Sep. 9, 1998 (DE) ..... 198 41 078

(51) Int. Cl.[7] ..... H01P 7/06

(52) U.S. Cl. ..... 333/235; 333/231; 333/232; 333/219.1; 331/107 DP

(58) Field of Search ..... 333/202, 224–226, 333/231, 232, 233, 235, 219.1, 219; 331/107 DP

(56) References Cited

U.S. PATENT DOCUMENTS

| | | | | |
|---|---|---|---|---|
| 3,121,205 A | * | 2/1964 | Foss | 333/233 |
| 3,213,393 A | * | 10/1965 | Powell et al. | 333/233 |
| 3,343,106 A | | 9/1967 | Honeyball et al. | 333/83 |
| 4,178,562 A | | 12/1979 | Torma et al. | 331/84 |
| 4,692,727 A | * | 9/1987 | Wakino et al. | 333/202 |
| 5,677,653 A | * | 10/1997 | Sarkka | 333/219.1 |
| 5,703,548 A | * | 12/1997 | Sarkka | 333/219.1 |
| 5,859,576 A | * | 1/1999 | Winandy | 333/232 |
| 6,111,484 A | * | 8/2000 | Henningsson et al. | 333/207 |

FOREIGN PATENT DOCUMENTS

| | | |
|---|---|---|
| DE | 1687622 | 9/1954 |

OTHER PUBLICATIONS

"Temperature Compensated High–Q Dielectric Resonators . . . ", Indra S. Ghosh, Et Al., 1997 IEEE Int. Freg. Cont. Symp., pp 1024–1029.

* cited by examiner

*Primary Examiner*—Seungsook Ham
(74) *Attorney, Agent, or Firm*—Liniak, Berenato & White, LLC

(57) ABSTRACT

The invention concerns a tunable cavity resonator that comprises a resonator body (2, 3, 4) defining a cavity (5), a tuning plate (28) whose position with respect to the resonator body (2, 3, 4) is modifiable and which influences the resonance frequency ($\omega_R$) of the cavity resonator, and an adjustment device (22, 26) for mechanically changing the position of the tuning plate (28), which is characterized in that a conversion ratio mechanism (18, 20) couples the adjustment device (22, 26) to the tuning plate (28) in terms of movement and converts a linear excursion ($\Delta x_1$) generated by the adjustment device (22, 26), at a predefined ratio (U), into a reduced linear excursion ($\Delta x_2$) that acts on the tuning plate (28), the conversion ratio mechanism (18, 20) comprising a first spring element (20) whose end toward the adjustment device is deflectable with the linear excursion ($\Delta x_1$) generated by the adjustment device (22, 26), and a second spring element (18) which impinges with an opposing force on the end of the first spring element (20) remote from the adjustment device.

18 Claims, 2 Drawing Sheets

TUNEABLE CAVITY RESONATOR

FIELD OF THE INVENTION

The invention concerns a tunable cavity resonator as defined in the preamble of claim 1. The invention further concerns a tunable microwave oscillator that uses a cavity resonator of such a kind.

BACKGROUND OF THE INVENTION

Tunable cavity resonators are used, inter alia, in microwave oscillators that are utilized to generate carrier signals in microwave communication. Such oscillators substantially comprise a microwave amplifier that is operated in feedback, and a high-quality cavity resonator that is located in the feedback path of the oscillator and filters out phase noise generated in the amplifier. A microwave oscillator of this kind furthermore uses a mechanical or electrical phase shifter to adjust the phase condition in the feedback path, and a high-frequency coupler to couple out the useful signal (carrier signal).

Adjustment of the oscillator frequency is accomplished in two stages: For coarse adjustment, first the resonance frequency of the tunable cavity resonator is modified in suitable fashion. This is done by means of the adjustment device with which the position of the tuning plate with respect to the resonator body is displaced. For fine adjustment of the oscillator frequency, the oscillator frequency is then shifted in controlled fashion within the resonance width of the tuned cavity resonator, using the phase shifter to displace the phase in the feedback path of the oscillator.

One difficulty with this type of two-stage toning of an oscillator results from the fact that the maximum frequency excursion achievable by phase adjustment is relatively small, for example only approximately 100 kHz for resonator qualities above $10^4$ (i.e. $Q>10^4$). Complete tunability of the microwave oscillator can only be achieved, however, if the minimum frequency change achievable in the context of resonance frequency tuning (i.e. cavity resonator tuning) is less than the aforementioned maximum frequency excursion when varying the phase in the feedback path of the oscillator. To meet this criterion, cavity resonators with an extremely high tuning accuracy are required.

It must be considered in this context that as the quality Q of a cavity resonator increases, the requirements in terms of the adjustment accuracy of the tuning mechanism in order to achieve a defined tuning accuracy also increase.

In practice, therefore, difficulties often occur in terms of the physical design of the tuning mechanism; and it has been found that the desired high adjustment accuracies, in combination with the necessary vibration resistance and good tuning reproducibility, are not always achieved.

The publication entitled "Temperature compensated high-Q dielectric resonators for long term stable low phase noise oscillators," Proceedings of the 1997 Frequency Control Symposium, I. S. Ghosh et al., pp. 1024–1029, describes a tunable cavity resonator as defined in the preamble of claim 1. This cavity resonator, with a quality $Q\approx10^5$, meets the tuning accuracy requirements necessary for continuous tunability of a microwave oscillator.

DE 1 687 62 discloses an apparatus for adjusting the spacing between a stationary and a movable partition element of a cavity resonator, a lever that is in engagement with the movable partition via a bearing element being arranged rotatably on the stationary partition element. The lever is displaced via a conically tapering segment. The wall of the cavity resonator is thereby moved in order to retune the frequency of the resonator. The linear excursion through which the lever travels at its free end is converted at the wall of the resonator into a reduced linear excursion.

SUMMARY OF THE INVENTION

It is the object of the invention to create a cavity resonator that possesses high adjustment accuracy in terms of its resonance frequency. The intention is, in particular, to make available a cavity resonator that exhibits high quality and nevertheless makes possible complete tunability of a microwave oscillator when used therein. A further purpose of the invention is to create a completely tunable microwave oscillator having a high-quality cavity resonator.

The features of claims 1 and 12 are provided in order to achieve the object. The result of the conversion ratio mechanism provided according to the present invention is that upon an actuation of the adjustment device, it is not the linear excursion generated by the adjustment device, but rather a linear excursion reduced with respect thereto, that adjusts the tuning plate. The consequence of this is that the minimum excursion change attainable with the adjustment device is transformed into an even smaller minimum excursion change acting on the tuning plate. As a result, the adjustment accuracy of the tuning plate is increased, compared to the adjustment accuracy of the adjustment device, by an amount equivalent to the predefined ratio of the conversion ratio mechanism. The predefined ratio (i.e. the transmission ratio) is determined by the spring constants of the two spring elements. The use of two spring elements pressing against one another has the advantage that the conversion ratio mechanism operates continuously and in a manner largely free of backlash.

In this instance, a particularly preferred variant embodiment is characterized in that the first spring element is formed from at least one cup spring, and the second spring element is implemented by a plate spring that is immobilized at the periphery and impinged upon centrally by the cup spring. A spring mechanism of this kind can be designed with sufficient stiffness to be insensitive to external shock or vibrations. In addition, suitable cup and plate springs can easily be manufactured with the requisite high spring constants.

The adjustment device preferably comprises an, in particular, manually actuable mechanical actuating element and a first electromechanical actuating element, in particular a first piezoelement, downstream from the mechanical actuating element. The first electromechanical actuating element makes possible electrical activation of the adjustment device, which is advantageous in particular when the adjustment device is operated in a closed-loop mode for adjustment of the resonance frequency $\omega_R$. The electromechanical actuating element can also be used, for example, to compensate for temperature-related drift, and can moreover, within a limited excursion range, eliminate the need for an actuation of the mechanical actuating element.

The tuning plate is preferably made of a dielectric material, in particular sapphire. A tuning plate of this kind has very low dielectric losses especially at low temperatures, so that the quality achievable for the cavity resonator (defined as the product of the resonance frequency OR times the quotient of the field energy stored in the resonator and the power dissipation occurring in the resonator) is high ($Q\approx10^7$).

The positionally adjustable tuning plate according to the present invention can also, in principle, be a wall element (for example the cover wall) of the cavity resonator. A particularly preferred exemplary embodiment of the invention is, however, characterized in that a dielectric element is provided in the resonator body; and that the tuning plate is arranged inside the resonator body at a small distance d from a flat surface of the dielectric element. With a design of this kind, much of the field energy is stored in the dielectric element, and a precise change in the resonance frequency of the cavity resonator can be achieved by means of a change in the position of the tuning plate.

When a dielectric element is used, a further variant implementation that is advantageous in terms of design consists in mounting the dielectric element on a displaceable base whose height can be modified by means of a second electromagnetic actuating element, in particular a second piezoelement. It is thereby possible, without great effort, to define a desired nominal or initial distance between the tuning plate and the flat surface of the dielectric element, which can then be finely adjusted in suitable fashion by the adjustment device according to the present invention with downstream conversion ratio mechanism.

The invention will be explained below by way of example with reference to an exemplary embodiment, with the aid of the drawings, in which:

DETAILED DESCRIPTION OF THE INVENTION

Figure 1:
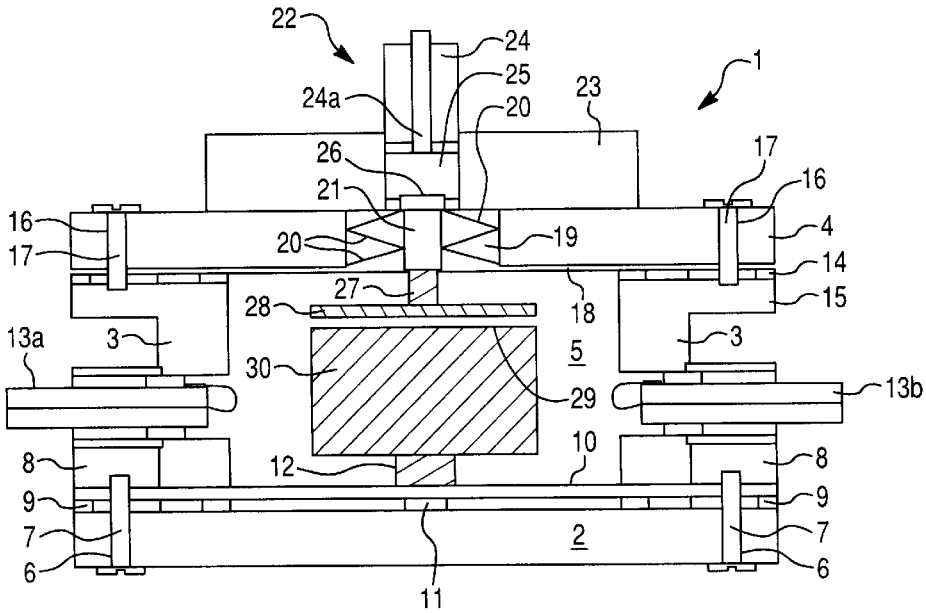
FIG. 1 is a schematic sectioned depiction of a cavity resonator according to the present invention.

FIG. 1 shows a cavity resonator 1 of cylindrical design having a resonance frequency $W_R$ in the GHz range. Cavity resonator 1 has a bottom plate 2 in the shape of a circular disk, a cylindrical peripheral wall 3, and a cover wall 4. Resonator wall elements 2, 3, and 4 are made of a metal having good electrical conductivity, for example Cu or an HTSL material, and define in their interior a cavity 5.

Bottom plate 2 has, distributed over its circumference, passthrough holes 6 through which pass threaded bolts 7 with which bottom plate 2 is fastened to a bottom flange 8 of peripheral wall 3. Arranged between bottom plate 2 and flange 8 is a spacer element 9 of predefined thickness in the shape of an annular disk, and above it a displaceable base 10 in the shape of a circular disk.

A multi-layer piezoelement 11 is located in the central region between bottom plate 2 and displaceable base 10. Multi-layer piezoelement 11 has a maximum excursion of a few $\mu$m, which can be transferred to displaceable base 10 and brings about a central bulging of the latter.

In the central region above multi-layer piezoelement 11, a dielectric pedestal element 12 that carries a dielectric cylinder 30 is arranged on displaceable base 10. Dielectric cylinder 30 is made of a dielectric material having a high dielectric constant $\in$ (for example, sapphire), and is arranged coaxially with peripheral wall 3 of cavity resonator 1.

A coupling-in antenna 13*a* and a coupling-out antenna 13*b* project through the cylindrical peripheral wall 3 into cavity 5. Coupling-in and coupling-out antennas 13*a*, 13*b* are each embodied as coaxial cables having coaxial loops configured at the ends.

Cover wall 4 of cavity resonator 1 is spaced away from a cover-side flange 15 of peripheral wall 3 by means of a spacer element 14 of predefined thickness in the form of an annular disk, and is secured to cover-side flange 15, in a manner similar to bottom wall 2, by way of threaded bolts 17 passing through passthrough holes 16.

A comparatively coarse preadjustment of the resonance frequency $\omega_R$ of cavity resonator 1 can be performed by using spacer elements 9, 14 with variable thicknesses.

A plate spring 18 configured in the form of a thin metal disk is secured at the rim between annular disk-shaped spacer element 14 and cover wall 4. In its central region, plate spring 18 delimits a cylindrical spring receiving space 19 present in cover wall 4. In the example depicted here, spring receiving space 19 contains three cup springs 20, arranged one above another, which are mounted around a central guide element 21 and are braced at the bottom against plate spring 18.

Located above cover wall 4 is a micrometer screw 22 that comprises a screw casing 23 joined immovably to cover wall 4, and a rotary member 24 guided therein in a fine-pitch thread. Rotary member 24 impinges, with an actuating pin 24*a* protruding at the bottom end, upon the upper end of a plunger 25, guided in a central bore of screw casing 23, whose lower end impinges upon a first multi-layer piezoelement 26 that acts on the upper cup spring 20.

When rotary element 24 is displaced, plunger 25 is moved in the axial direction with high adjustment accuracy (for example, 50 $\mu$m per revolution). The movement travel is transferred to first multi-layer piezoelement 26 and can be additionally modified, i.e. shortened or lengthened, by it. The linear excursion $\Delta x_1$ occurring at the output end of first multi-layer piezoelement 26 acts on the topmost cup spring 20 and compresses it. Cup springs 20 press on plate spring 18 and deflect it in its central region over a deflection travel $\Delta x_2$. Because of the opposing force exerted by plate spring 18, the output-end deflection travel $\Delta x_2$ is smaller than the input-end linear excursion $\Delta x_1$. The reduction in the deflection travel $\Delta x_2$ as compared to $\Delta x_1$, is determined by the spring constant $k_1$ of the cup spring stack and the spring constant $k_2$ of plate spring 18.

If the spring constants are identical ($k_1=k_2$), the result is to shorten the movement travel by a factor of 2.

A tuning disk 28 is mounted by way of a rod 27 on the side of plate spring 18 facing away from spring receiving space 19. Tuning disk 28 extends parallel to and at a short distance d from a flat surface 29 of dielectric cylinder 30. A central deflection $\Delta X_2$ of plate spring 18 toward the bottom end causes tuning disk 28 also to be displaced by a distance $\Delta x_2$ so that a previously adjusted distance d between tuning disk 28 and cylindrical body 30 is shortened to $d-\Delta x_2$.

Figure 2:
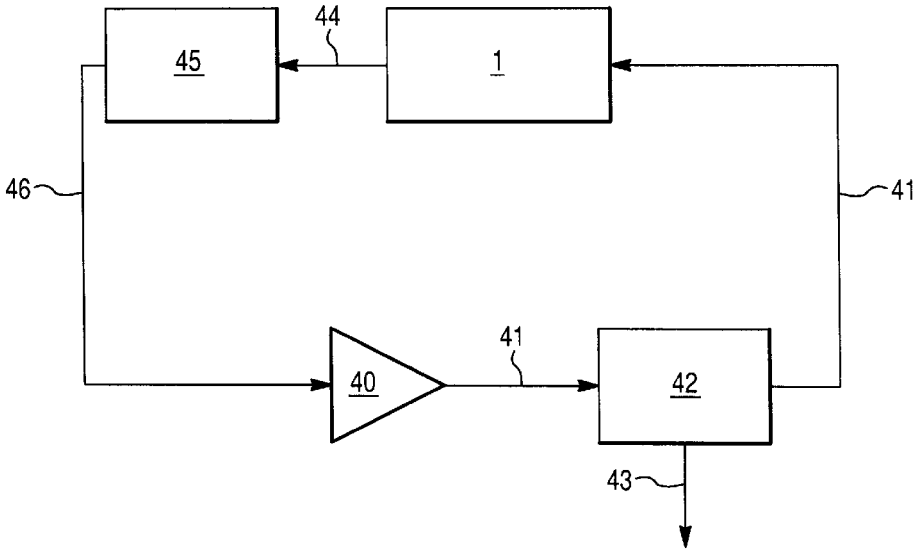
FIG. 2 shows a block diagram of a microwave oscillator that uses the cavity resonator shown in FIG. 1.

FIG. 2 shows, in the form of a block diagram, the general construction of a microwave oscillator that uses cavity resonator 1 depicted in FIG. 1. An amplifier signal 41 of an amplifier 40 is conveyed to a high-frequency coupler 42. High-frequency coupler 42 on the one hand couples a useful signal 43 out of amplifier signal 41, and on the other hand sends amplifier signal 41 on to cavity resonator 1. The coupling of amplifier signal 41 into cavity resonator 1 is accomplished via input antenna 13*a*.

An output signal 44 is coupled out of cavity resonator 1 via output antenna 13*b* and conveyed to an electrically or mechanically actuable phase shifter 45 which is provided in order to adjust the phase condition in feedback path 41, 42, 1, 44, 45. The phase-shifted feedback signal 46 generated by phase shifter 45 is fed into amplifier 40.

As already mentioned, the microwave oscillator can be continuously tuned only if cavity resonator 1 achieves a requisite resonance frequency adjustment accuracy $\Delta\omega_R$ of approximately 100 kHz or less. It is unfavorable in this context that the tuning slope $\Delta\omega_R/\Delta x_2$ of a cavity resonator increases in proportion to its quality Q. With resonators 1 of comparatively low quality ($Q\approx10^4$), a typical tuning slope of 10 kHz/$\mu$m is observed. This means that the adjustment accuracy of the tuning mechanism, in terms of the achievable positional accuracy of tuning plate 28, needs to be only approximately 10 $\mu$m in order to achieve the requisite tuning accuracy $\Delta\omega_R$ of 100 kHz for the resonance frequency.

The tuning slope for a quality $Q\approx10^7$, on the other hand, is already $10^3$ kHz/$\mu$m. A quality $Q\approx10^7$ can be achieved, in the context of cavity resonator 1 according to the present invention, by cooling the latter to approximately 77 K, since this allows the dielectric losses occurring in dielectric cylinder 30 for so-called whispering gallery modes to be greatly reduced. In order to achieve continuous tunability of a microwave oscillator with the cooled cavity resonator 1, the tuning mechanism of cavity resonator 1 must then have an adjustment accuracy of 0.1 $\mu$m.

Conversion ratio mechanism 18, 20 depicted in FIG. 1 makes it possible to achieve such adjustment accuracy when a micrometer screw 22 having an adjustment accuracy of 50 $\mu$m per revolution is used, and thus allows implementation of a completely tunable microwave oscillator having a cavity resonator 1 with a quality $Q\approx10^7$.

The high adjustment accuracy of tuning mechanism 22, 20, 18 is due not only to the reduction according to the present invention in movement travel by way of conversion ratio mechanism 18, 20, but also to the fact that because conversion ratio mechanism 18, 20 is constructed from spring elements placed one behind another, practically no backlash occurs in it. This additionally makes possible excellent reproducibility for the adjustment position.

A further essential advantage of tuning mechanism 22, 20, 18 is its mechanical stability and vibration resistance, especially at relatively low excitation frequencies (<1 kHz). This is due not only the aforementioned robust and substantially zero-backlash design of conversion ratio mechanism 18, 20, but also on the one hand to the high natural mechanical frequencies of plate spring 18 and on the other hand to the large forces that must be applied in order to deflect it (for example, $k_2$=5000 N/m). An extremely low susceptibility to "microphoning" is thereby achieved, and even if cavity resonator 1 is cooled by means of a commercial miniature cooler 1 [sic], no transfer of cooler vibrations into the resonance frequency spectrum is observed.

Preferably the first and second multi-layer piezoelements 26, 11 can also be used for electrical adjustment of the resonance frequency $\omega_R$. In this context, first multi-layer piezoelement 26 causes a movement of tuning plate 28 relative to the stationary dielectric cylinder 30, while operation of second multi-layer piezoelement 11 results in a movement of dielectric cylinder 30 relative to the stationary tuning plate 28. In particular, first multilayer piezoelement 26 placed upstream from conversion ratio mechanism 18, 20 makes possible very accurate fine electrical adjustment of resonance frequency $\omega_R$ and is thus particularly suitable as an actuating element for regulating the resonance frequency $\omega_R$ in a closed-loop mode.

Figure 3:
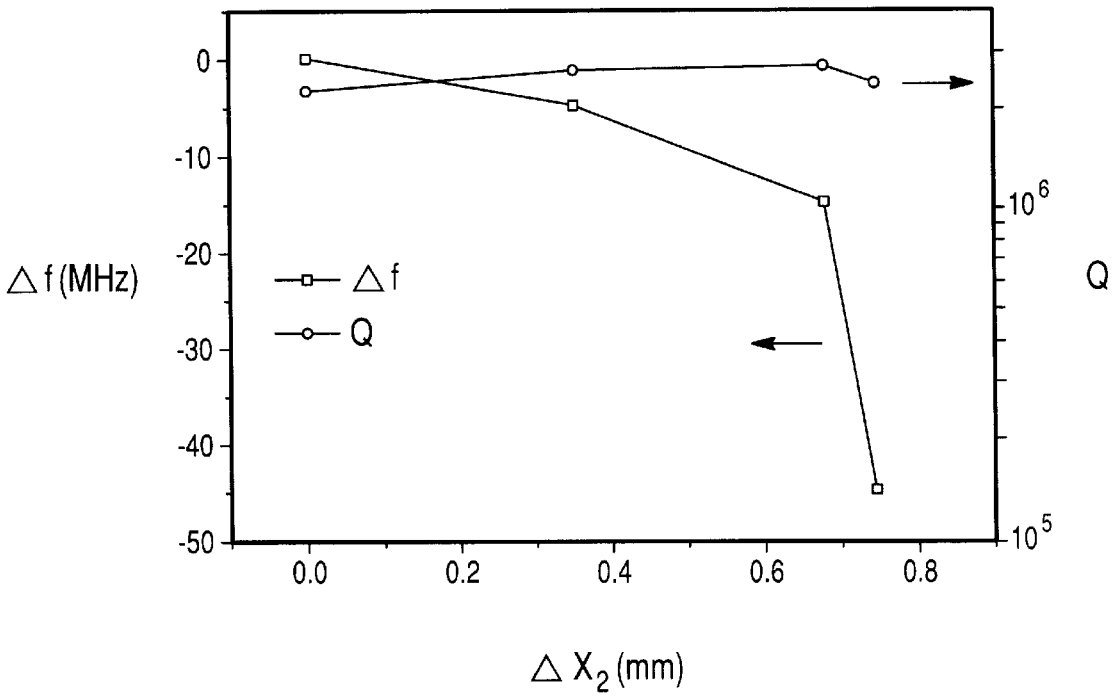
FIG. 3 shows a diagram in which the change in oscillator frequency $\Delta f$ is depicted as a function of the change in position $\Delta x_2$ of the tuning plate.

FIG. 3 depicts a diagram that elucidates the tuning behavior of the oscillator shown in FIG. 2 under the following exemplary conditions: Cavity resonator 1 is cooled to a temperature of 77° K., and has a dielectric cylinder 30 made of sapphire. A micrometer screw 22 having an excursion of 50 $\mu$m per revolution is used, as well as three cup springs 20 and a plate spring 18 that is 1 mm thick ($k_2$=5000 N/mm). Tuning plate 28 is made of sapphire and has a thickness of 0.5 mm. Tuning is performed at a frequency of 23 GHz.

The Y axis shown on the left side of FIG. 3 depicts the change in oscillator frequency $\Delta f$ as a function of the linear excursion $\Delta x_2$ of tuning plate 28, plotted on the X axis. A change of 0.75 mm in the linear excursion $\Delta x_2$ corresponds to a frequency change of 45 MHz.

Under the conditions specified, a minimum mechanical change in the position of tuning plate 28 of $\Delta x_2(\min)<0.2$ $\mu$m is achieved. FIG. 3 shows that for small distances d<0.3 mm between tuning plate 28 and dielectric cylinder 30, this corresponds approximately to a minimum change in resonance frequency $\Delta\omega_R(\min)$=4 kHz. This frequency change attainable by mechanical retuning of cavity resonator 1 is thus much smaller than the maximum frequency variation of approximately 100 kHz that can be effected by phase shifter 45, i.e. the condition mentioned initially for continuous tunability of the microwave oscillator is easily met.

The quality Q of cavity resonator 1, plotted on the Y axis shown on the right side of FIG. 3, is largely constant over the entire tuning range of the microwave oscillator, and in the example here is $Q>2\cdot10^6$. Even during an adjustment operation, practically no degradation occurs in the quality of cavity resonator 1.

What is claimed is:

1. A tunable cavity resonator, comprising:

a resonator body (2, 3, 4) defining a cavity (5);

a tuning plate (28) whose position with respect to the resonator body (2, 3, 4) is adjustable and which influences the resonance frequency ($\omega_R$) of the cavity resonator; and an adjustment device (22, 26) for mechanically changing the position of the tuning plate (28), characterized by a conversion ratio mechanism (18, 20) which couples the adjustment device (22, 26) to the tuning plate (28) in terms of movement and which converts a linear excursion ($\Delta x_1$) generated by the adjustment device (22, 26), at a predefined ratio (U), into a reduced linear excursion ($\Delta x_2$) that acts on the tuning plate (28), the conversion ratio mechanism (18, 20) comprising a first spring element (20) whose end toward the adjustment device is deflectable with the linear excursion ($\Delta x_1$) generated by adjustment device (22, 26), and a second spring element (18) which impinges with an opposing force on the end of the first spring element (20) remote from the adjustment device.

2. The tunable cavity resonator as defined in claim 1, characterized in that the first spring element is formed from at least one cup spring (20); and that the second spring element is implemented by a plate spring (18) that is immobilized at the periphery and impinged upon centrally by the cup spring (20).

3. The tunable cavity resonator as defined in claim 2, characterized in that the resonator body comprises a cylindrical peripheral wall (3), a cover wall (4), and a bottom wall (2);

a cylindrical spring receiving space (19) coaxial with the peripheral wall axis and containing a cup spring (20) is configured in at least one of the cover wall (4) and the bottom wall (2); and that the plate spring (18) is immobilized in its radially external region between a flange (15) of the peripheral wall (3) and the cover wall or bottom wall (4; 2).

4. The tunable cavity resonator as defined in claim 1, characterized in that the adjustment device (22, 26) comprises a manually actuable mechanical actuating element, and a first electromechanical actuating element, downstream from the mechanical actuating element.

5. The tunable cavity resonator as defined in claim 3, characterized in that one or more spacer elements (9; 14) of predefined thickness are arranged between the flange (15) of the peripheral wall (3) and at least one of the bottom wall and the cover wall (2; 4).

6. The tunable cavity resonator as defined in claim 1, characterized in that the tuning plate (28) is made of a dielectric material.

7. The tunable cavity resonator as defined in claim 1, characterized in that a dielectric element (30) is provided in the resonator body (2, 3, 4); and that the tuning plate (28) is arranged inside the resonator body (2, 3, 4) at a small distance (d) from a flat surface (29) of the dielectric element (30).

8. The tunable cavity resonator as defined in claim 7, characterized in that the dielectric element (30) is mounted on a displaceable base (10) whose height can be modified by means of a second electromechanical actuating element.

9. The tunable cavity resonator as defined in claim 1, characterized in that at least one of a first and a second electromechanical actuating element (11; 26) receives an electrical control signal, output by an activation circuit, by means of which the cavity resonator (1) is operated in a closed-loop frequency control mode.

10. The tunable cavity resonator as defined in claim 1, characterized in that the cavity resonator (1) is thermally connected to an external cooling device.

11. A tunable microwave oscillator comprising a cavity resonator as defined in claim 1, said tunable microwave oscillator further comprising an amplifier (40) which outputs an amplifier signal (41) that excites the cavity resonator (1), and a phase shifter (45) which receives an output signal (44) coupled out from the cavity resonator (1) and makes available a feedback signal (46), phase-shifted with respect to the output signal (44), which is delivered to an input of the amplifier (40).

12. The tunable microwave oscillator as defined in claim 11, characterized in that the cavity resonator (1) has a quality $Q>10^6$; and that the conversion ratio mechanism (18, 20) of the cavity resonator (1) is designed in such a way that the minimum change in the resonance frequency ($\Delta\omega_R(\min)$) achievable by a minimum possible displacement of the adjustment device (22) is less than the maximum frequency excursion ($\Delta\omega_R$) of the resonance frequency (OR) achievable by a displacement of the phase shifter (45).

13. The tunable cavity resonator as defined in claim 4, wherein said manually actuable mechanical actuating element is a rotary actuating element (22).

14. The tunable cavity resonator as defined in claim 4, wherein said first electromechanical actuating element is a first piezoelement (26).

15. The tunable cavity resonator as defined in claim 6, wherein said dielectric material is sapphire.

16. The tunable cavity resonator as defined in claim 8, wherein said second electromechanical actuating element is a second piezoelement (11).

17. The tunable cavity resonator as defined in claim 10, wherein said external cooling device is a mechanical miniature cooler.

18. The tunable microwave oscillator as defined in claim 12, wherein said cavity resonator (1) has a quality $Q>10^7$.

* * * * *